US005539170A

United States Patent [19]

Palmer et al.

[11] Patent Number: 5,539,170

[45] Date of Patent: Jul. 23, 1996

[54] ARC GRID PLATE FOR ELECTRICAL SWITCHING DEVICE

[75] Inventors: Nelson R. Palmer, Arden; David N. Freck, Fairview, both of N.C.

[73] Assignee: Eaton Corporation, Cleveland, Ohio

[21] Appl. No.: 360,873

[22] Filed: Dec. 21, 1994

[51] Int. Cl.[6] ..... H01H 33/10

[52] U.S. Cl. ..... 218/149; 218/34; 218/151

[58] Field of Search ..... 218/15, 22, 34, 218/35, 36–40, 46, 76, 81, 103, 105, 106, 148, 149, 150, 151, 156, 157

[56] References Cited

U.S. PATENT DOCUMENTS

| | | | |
|---|---|---|---|
| 2,590,543 | 3/1952 | Kalaway | 200/144 |
| 2,719,203 | 9/1955 | Gelzheiser et al. | 200/144 |
| 2,734,970 | 2/1956 | Spears, Jr. | 200/147 |
| 3,662,133 | 5/1972 | Bould et al. | 200/144 R |
| 4,107,497 | 8/1978 | Jencks et al. | 200/144 R |
| 4,405,847 | 9/1983 | Morton | 200/144 R |
| 4,893,102 | 1/1990 | Bauer | 335/132 |

*Primary Examiner*—Kristine L. Kincaid
*Assistant Examiner*—Michael A. Friedhofer
*Attorney, Agent, or Firm*—Martin J. Moran

[57] ABSTRACT

An arc grid plate for an arc box of a contactor includes a conductive plate having two sides, a rear edge, and a front arc edge. The sides are slidable within a pair of grooves of the side walls of the arc box. The rear edge of the conductive plate has two arms which are rearwardly disposed therefrom. Each of the arms has a pointed end for gripping an associated one of the side walls. The pointed ends are generally disengaged from the associated side walls during insertion of the conductive plate into the arc box. The arms are engaged by the rear wall of the arc box and flex forwardly toward the rear edge of the conductive plate in order that the pointed ends of the arms engage the associated side walls and retain the conductive plate within the grooves of the arc box.

20 Claims, 2 Drawing Sheets

FIG. 1
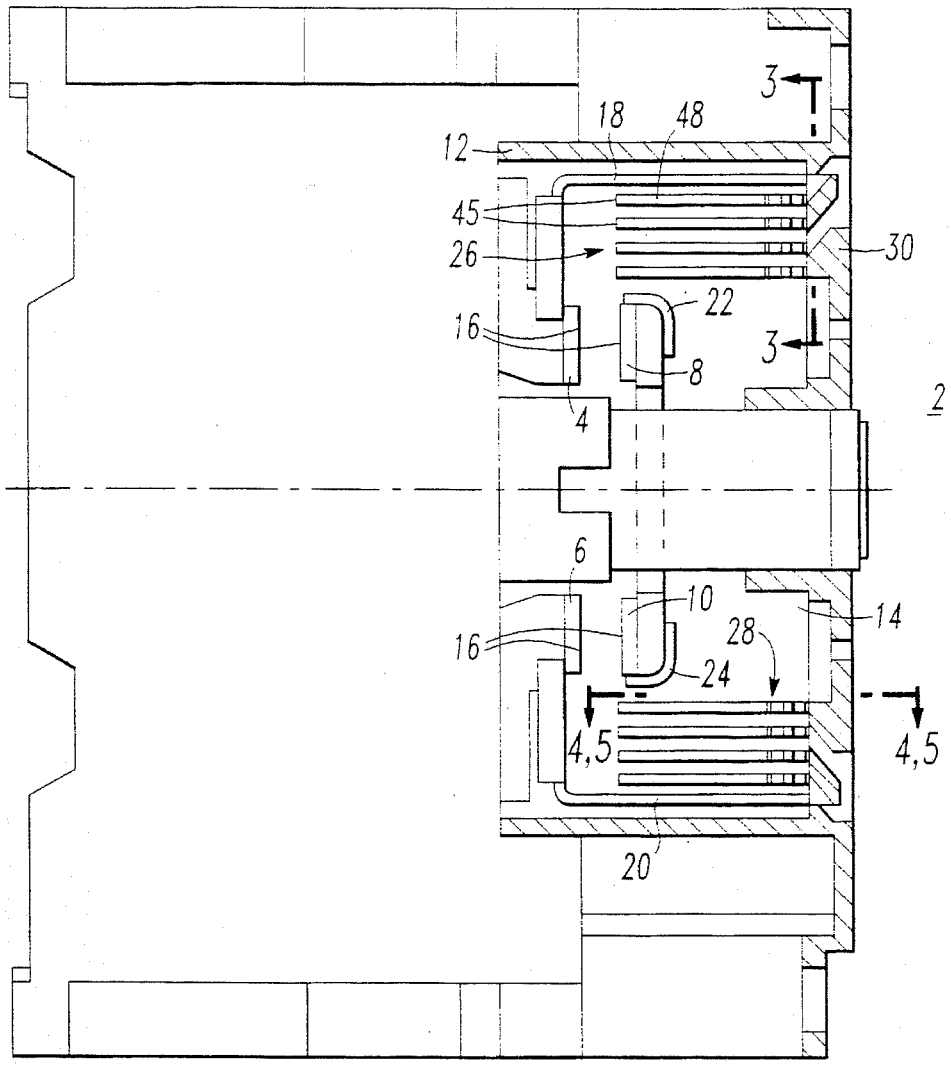
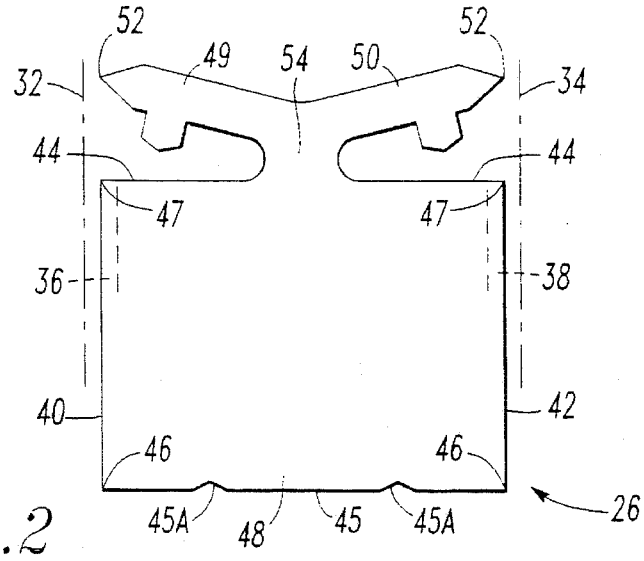
FIG. 2

ARC GRID PLATE FOR ELECTRICAL SWITCHING DEVICE

BACKGROUND OF THE INVENTION

1. Field of the Invention

This invention relates to an improved arc grid for use with an electrical switching device and, more particularly, to such a grid having improved arc grid plates for use with a circuit interrupter such as an electromagnetic contactor. The invention also relates to an electrical switching device having improved arc grid plates.

2. Background of Information

Electrical switching devices include, for example, electromagnetic switching devices such as circuit breakers, circuit interrupters and other circuit switching devices. Circuit interrupters, for example, are electrically operated switches used for controlling motors and other types of electrical loads. Circuit interrupters include, for example, contactors, motor starters, motor controllers and other electromechanical switching devices. Electromagnetic contactors, for example, include a set of movable electrical contacts which are brought into contact with a set of fixed electrical contacts to close the contactor. The set of movable contacts is separated from the set of fixed contacts to open the contactor. One of the fixed contacts is connected to a line terminal and the other of the fixed contacts is connected to a load terminal. The line terminal is connected to a power source and the load terminal is connected to a load in order to selectively source current from the power source to the load.

During a contact breaking cycle, pairs of fixed and movable contacts part. The current flowing through each pair of contacts forms an arc therebetween. The arc erodes the contacting surfaces of the contacts until the arc is extinguished. In order to minimize the arc between the contacting surfaces, a plurality of parallel arc plates are disposed between a first conductor which is electrically connected to the fixed contact and a second conductor which is electrically connected to the movable contact. In this manner, the arc is primarily directed between the first conductor, the arc plates, and the second conductor without adversely eroding the contacting surfaces.

The pair of contacts and the first and second conductors are housed within an arc chamber of an arc box. It is known to position a plurality of parallel, generally rectangular arc plates within the arc chamber between the conductors. The sides of the arc box have a plurality of opposing grooves in which the sides of the arc plates rest. It is also known to provide a plurality of foot-shaped grippers on each of the sides of the arc plates in order to retain each arc plate in a pair of the opposing grooves. Each of the grippers has a heel disposed along the side of each arc plate and a toe pointing outwardly from the side. Each arc plate is inserted heel first into the pair of opposing grooves in order that the toes flex inwardly away from the edges of the grooves thereby resisting, but not preventing, insertion of the arc plate. After each arc plate is fully inserted within the pair of opposing grooves, the toes dig into the edges of the grooves when a force is applied to remove the arc plate.

During operation of the contactor, the arc erodes a front edge of the arc plates which is closest to the current path of the arc between the first conductor and the second conductor. During rapid operation of the contactor at moderate to high currents, the arc also erodes the molded material of the sides of the arc box closest to the arc. As the sides of the arc box erode, the toes loosen their grip on the edges of the opposing grooves. In turn, the arc plates and the arc tend to slip toward the pair of contacts causing the temperature of the contacting surfaces to rise, thereby accelerating the erosion of the contacts and reducing the useful electrical life thereof.

There is a need, therefore, for an improved arc plate for a contactor which decreases the erosion rate of the separable contacts.

There is a more particular need for such an arc plate having grippers which maintain the grip on the edges of the opposing grooves of the arc box.

There is an even more particular need for such an arc plate which is easier to install within the opposing grooves of the arc box.

SUMMARY OF THE INVENTION

These and other needs are satisfied by the invention which is directed to a grid plate for an arc box of an electrical switching device. The arc box has a rear wall and two side walls each of which has a groove. The grid plate includes a conductive plate having two sides and a rear edge. Each of the sides is slidable within the groove of one of the side walls of the arc box. The rear edge of the conductive plate has two arms which are rearwardly disposed therefrom. Each of the arms has a gripping mechanism for gripping an associated one of the side walls. Each of the gripping mechanisms is generally disengaged from the associated one of the side walls during insertion of the sides of the conductive plate into the grooves of the arc box. Each of the arms is engaged by the rear wall of the arc box and flexes forwardly toward the rear edge of the conductive plate in order that each of the gripping mechanisms engages the associated one of the side walls and retains the conductive plate within the grooves of the arc box.

The arms may be rearwardly disposed from about the center of the rear edge of the conductive plate. The arms may be angularly disposed with respect to the rear edge during insertion of the sides of the conductive plate into the grooves of the arc box. The arms may be generally parallel with respect to the rear edge after each of the gripping mechanisms engages the associated one of the side walls. The arms may have a first edge which faces the rear wall, a second edge which faces the rear edge, and an end which faces the associated one of the side walls after each of the gripping mechanisms engages the associated one of the side walls. The first and second edges may be generally straight with portions which angle toward the end. The gripping mechanism may be a point at the end formed by the portions which angle thereto.

Alternatively, an electrical switching device includes separable contacts which interrupt current through the device when opened, the separable contacts having a first conductor and a second conductor electrically connected thereto; an arc box mechanism for housing the separable contacts therein, the arc box mechanism having a rear wall and two side walls each of which has a plurality of parallel grooves; and a plurality of conductive plates. Each of the conductive plates has two sides and a rear edge. Each of the sides are slidable within one of the grooves of one of the side walls of the arc box mechanism. The rear edge has two arms which are rearwardly disposed therefrom. Each of the arms has a gripping mechanism for gripping an associated one of the side walls. Each of the gripping mechanisms is generally disengaged from the associated one of the side walls during insertion of the sides of one of the conductive plates into a pair of the grooves of the arc box mechanism. Each of the arms is engaged by the rear wall of the arc box mechanism and flexes forwardly toward the rear edge of the conductive plate in order that each of the gripping mechanisms engages the associated one of the side walls and retains the conductive plate within the pair of the grooves of the arc box mechanism. A portion of each of the conductive plates is disposed between the first conductor and the second conductor in order to strike an arc therebetween when the separable contacts are opened.

The conductive plates may be planar with a front arc edge which is coplanar with the front arc edge of each other of the conductive plates. The arc between the first conductor and the second conductor may be generally struck between the front arc edges of each of the conductive plates. The conductive plates may be generally rectangular with the front arc edge being opposite the rear edge. The two sides of the arc plate may each have a front end which terminates at the front arc edge and a rear end which terminates at the rear edge. Each of the gripping mechanisms may grip a portion of the associated one of the side walls. The gripping mechanisms may each engage the associated one of the side walls between the rear end of the arc plate and the rear wall of the arc box mechanism in order that the arc which is generally struck between the front arc edges of each of the conductive plates is separated from the portions of the Side walls which are gripped by the gripping mechanisms.

BRIEF DESCRIPTION OF THE DRAWINGS

A full understanding of the invention can be gained from the following description of the preferred embodiment when read in conjunction with the accompanying drawings in which:

FIG. 1 is a vertical sectional view of a contactor having a plurality of arc plates in an arc box in accordance with the invention;

FIG. 2 is a plan view of an arc plate in accordance with the invention;

DESCRIPTION OF THE PREFERRED EMBODIMENT

Figure 3:
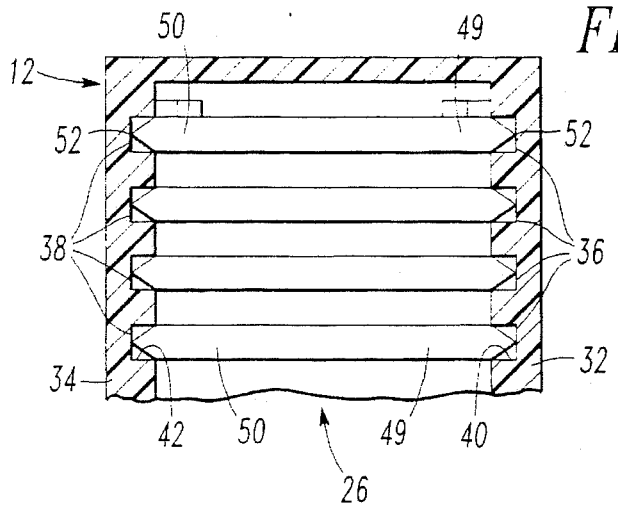
FIG. 3 is a cross sectional view along lines 3—3 of FIG. 1.

Referring to FIG. 1, a contactor 2 includes a pair of fixed contacts 4,6 and a pair of movable contacts 8,10 shown in an open position. A complete description of a contactor is disclosed in U.S. Pat. No. 4,893,102, issued Jan. 9, 1990, which is herein incorporated by reference, it being understood that the present invention is applicable to a wide variety of electrical switching devices such as, for example, circuit breakers, motor starters, motor controllers, and other circuit switching devices. The movable contacts 8,10 are disengaged from the fixed contacts 4,6, respectively, in order to break the electrical circuit therebetween. The contactor 2 also includes an arc box 12 having an arc chamber 14 in which the contacts 4,6,8,10 are housed, although the invention is applicable to plural-phase electrical switching devices having a plurality of arc chambers (e.g., a three-phase circuit breaker with three pairs of separable contacts, etc.).

Figure 4:
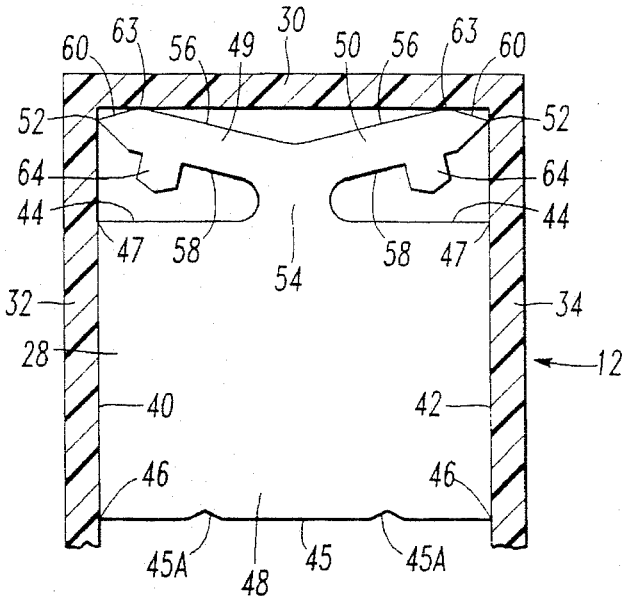
FIG. 4 is a cross sectional view along lines 4—4 of FIG. 1 with the arc plate partially installed in the arc box.
Figure 5:
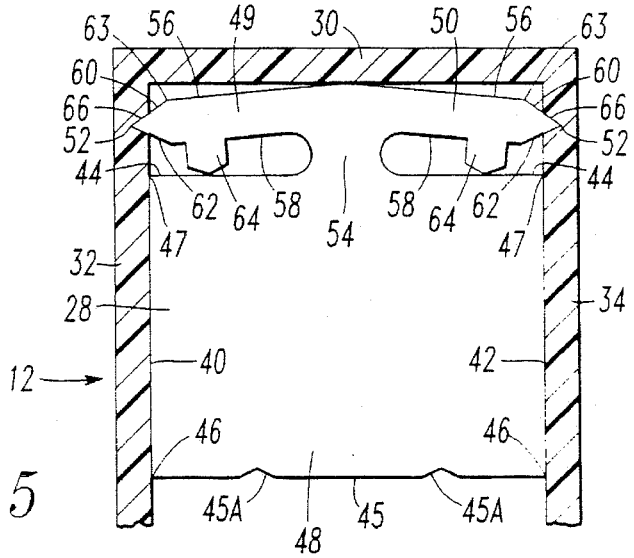
FIG. 5 is a cross sectional view along lines 5—5 of FIG. 1 with the arc plate fully installed in the arc box.

Each of the contacts 4,6,8,10 has a conductive contacting surface 16. Two L-shaped conductors 18,20 are electrically connected to the contacting surfaces 16 of the fixed contacts 4,6, respectively. Two L-shaped conductors 22,24 are electrically connected to the contacting surfaces 16 of the movable contacts 8,10, respectively. Also referring to FIG. 2, disposed within the arc chamber 14 between the conductors 18,22 are a plurality of planar conductive arc grid plates 26 which are arranged in a parallel fashion to form an arc grid. Similarly disposed between the conductors 20,24 are a plurality of planar conductive arc grid plates 28. As shown in FIGS. 4 and 5, the arc box 12 has a rear wall 30 and two side walls 32,34. As shown in FIG. 3, the sidewalls 32,34 have a plurality of parallel grooves 36,38, respectively.

Referring to FIGS. 2 and 3, the arc plate 26 is illustrated. Preferably, the arc plate 26 is made of 0.083 inch thick sheet steel, although any conductive material or conductive-magnetic material, such as, for example, iron, nickel, cobalt, etc. may be used. The generally rectangular arc plate 26 has two sides 40,42, a rear edge 44, and a front arc edge 45 opposite the rear edge 44. Each of the sides 40,42 of the arc plate 26 has a front end 46 which terminates at about the front arc edge 45 and a rear end 47 which terminates at about the rear edge 44. Each of the arc plates 28 of FIG. 1 is identical to the arc plate 26.

As best shown in FIG. 1, an exemplary front portion 48 of each of the arc plates 26 is disposed between the conductor 18 of the fixed contact 4 and the conductor 22 of the movable contact 8. The front arc edges 45 of the arc plates 26 are generally disposed in a common plane between the conductors 18,22. When the movable contact 8 disengages from the fixed contact 4, an arc is generally struck between the conductor 18, the front arc edges 45 of the parallel arc plates 26, and the conductor 22. The movable contact 10, the fixed contact 6, the conductors 20,24, and the arc plates 28 function in a similar manner.

As shown in FIG. 3, the sides 40,42 of the arc plate 26 are slidable within the grooves 36,38 of the side walls 32,34, respectively, of the arc box 12. As shown in FIG. 2, the rear edge 44 of the arc plate 26 has two arms 49,50 which are rearwardly disposed therefrom. As best shown in FIG. 3, each of the arms 49,50 has a pointed end 52 which grips an associated one of the side walls 32,34, respectively. As shown in FIG. 2, the pointed ends 52 are generally disengaged from the side walls 32,34 (shown in phantom line drawing) during insertion of the sides 40,42 of the arc plate 26 into a pair of the grooves 36,38 (shown in phantom line drawing). The arms 49,50 are angularly disposed with respect to the rear edge 44 during insertion of the sides 40,42 of the arc plate 26 into the grooves 36,38. Preferably, each of the arms 49,50 is disposed at an angle of 32 degrees with respect to the rear edge 44.

As shown in FIG. 4, the arms 49,50 are first engaged by the rear wall 30 of the arc box 12. When sufficient pressure is applied to the front arc edge 45, the arms 49,50 flex forwardly toward the rear edge 44 of the arc plate 28 as shown in FIG. 5. Each of the arms 49,50 of FIG. 5 is generally parallel with respect to the rear edge 44 after each of the pointed ends 52 engages the associated one of the side walls 32,34, respectively. As best shown in FIG. 3, the pointed ends 52 of the arms 49,50 engage the side walls 32,34 and, thus, retain the arc plate 26 within the pair of the grooves 36,38, respectively, of the arc box 12.

As shown in FIG. 2, the arms 49,50 are attached to and are rearwardly disposed from an extension 54 at about the center of the rear edge 44. As shown in FIG. 5, each of the arms 49,50 of the arc plate 28 has a first edge 56 which faces the rear wall 30 and a second edge 58 which faces the rear edge 44 of the arc plate 28. The pointed ends 52 of the arms 49,50 face the side walls 32,34, respectively. The first edge 56 is generally straight and has an angled end portion 60 which angles toward the pointed end 52. The second edge 58 is generally straight and has an end portion 62 which angles toward the pointed end 52.

Referring to FIGS. 4 and 5, the second edge 58 of the arms 49,50 has a tab 64 which extends forwardly and transversely therefrom toward the rear edge 44 of the arc plate 28. As shown in FIG. 4, the first edge 56 of the arms 49,50 has an intermediate portion 63 adjacent the end portion 60 and opposite from the pointed end 52. The intermediate portion 63 of the first edge 56 of each of the arms 49,50 first engages the rear wall 30 before the pointed ends 52 engage the side walls 32,34 of the arc box 12. After the intermediate portions 63 of the edges 56 engage the rear wall 30, in response to continued rearward movement of the arc plate 28 caused by pressure applied to the front arc edge 45, the arms 49,50 flex forwardly toward the rear edge 44 of the arc plate 28. Then, as shown in FIG. 5, each of the pointed ends 52 engages the associated one of the side walls 32,34 between the rear end 47 of the arc plate 28 and the rear wall 30 of the arc box 12.

In this manner, the arc which is generally struck between the front arc edges 45 at the front portion 48 of the arc plates 26,28 of FIG. 1 is separated from the portions 66 of the side walls 30,32 which arc gripped by the pointed ends 52. Normally, the arc strikes sharp edges such as the portions 45A of the front arc edge 45. The exemplary pointed gripping mechanisms 52 at the rear of the exemplary arc plates 26,28 are moved as far as possible rearwardly from the front arc edge 45.

After the pointed ends 52 of the arms 49,50 first touch the side walls 32,34 and are fully engaged therein, the ends of the tabs 64 of the arms 49,50 engage the rear edge 44 of the arc plate 28. In this manner, each of the arms 49,50 remains generally parallel with respect to the rear edge 44 of the arc plate 28. Preferably, the length of the tabs 64 is slightly smaller than the length of the extension 54 in order that each of the arms 49,50 angles forward from the rear wall 30 of the arc box 12 and toward the rear edge 44 of the arc plate 28 at about an angle of 3 degrees. In this manner, the pointed ends 52 provide an optimum grip on the side walls 32,34.

After installation of the exemplary arc plates 26,28 of FIG. 1 in the exemplary arc box 12, the plates 26,28 provide an increased interference with respect to prior art arc plates. This increased interference prevents slippage of the plates 26,28 toward the contacts 4,6,8,10. As shown in FIG. 5, the exemplary placement of the pointed ends 52 of the arms 49,50 is behind the rear edge 44 of the arc plate 28 and away from the front arc edge 45. This placement moves the pointed ends 52 and the gripped portions 66 of the side walls 32,34 away from the arc at the front portion 48 of the plates 26,28 of FIG. 1, thereby improving the interruption endurance of the arc box 12.

As shown in FIG. 2, the exemplary arc plate 26 is generally freely insertable within the grooves 36,38 of the arc box 12. As shown in FIGS. 4 and 5, the flexing of the arms 49,50 by the rear wall 30 and the interference between the pointed ends 52 of the arms 49,50 and the side walls 32,34, respectively, occur during the final insertion of the arc plates 26,28 of FIG. 1 into the arc box 12. This obviates the need for a loading fixture for the arc plates 26,28 and facilitates automated loading of the plates 26,28 because of the improvement in the gripping mechanism with respect to prior art devices.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the appended claims and any and all equivalents thereof.

What is claimed;

1. A grid plate for an arc box of an electrical switching device, the arc box having a rear wall and two side walls each of which has a groove, said grid plate comprising:

a conductive plate having two sides and a rear edge; each of the sides being slidable within the groove of one of the side walls of said arc box; the rear edge of said conductive plate having two arms being rearwardly disposed therefrom, each of the arms having gripping means for gripping an associated one of the side walls, each of the gripping means being generally disengaged from the associated one of the side walls during insertion of the sides of said conductive plate into the grooves of said arc box, each of the arms being engaged by the rear wall of said arc box and flexing forwardly toward the rear edge of said conductive plate in order that each of the gripping means engages the associated one of the side walls and retains said conductive plate within the grooves of said arc box.

2. The grid plate as recited in claim 1 wherein the rear edge of said conductive plate has a center; and wherein each of the arms is rearwardly disposed from about the center of the rear edge.

3. The grid plate as recited in claim 2 wherein each of the arms is angularly disposed with respect to the rear edge during insertion of the sides of said conductive plate into the grooves of said arc box; and wherein each of the arms is generally parallel with respect to the rear edge after each of the gripping means engages the associated one of the side walls.

4. The grid plate as recited in claim 1 wherein each of the arms has a first edge which faces the rear wall, a second edge which faces the rear edge, and an end which faces the associated one of the side walls after each of the gripping means engages the associated one of the side walls.

5. The grid plate as recited in claim 4 wherein the second edge has a tab which extends forwardly therefrom toward the rear edge in order to engage the rear edge after each of the gripping means engages the associated one of the side walls.

6. The grid plate as recited in claim 4 wherein the second edge has a tab which extends generally transversely therefrom toward the rear edge and which engages the rear edge when each of the gripping means fully engages the associated one of the side walls in order that each of the arms remains generally parallel with respect to the rear edge.

7. The grid plate as recited in claim 4 wherein the rear edge has an extension on which both of the arms are attached; wherein the second edge has a tab which extends generally transversely therefrom toward the rear edge of said conductive plate and which engages the rear edge when each of the gripping means fully engages the associated one of the side walls, the tab having a length which is smaller than a length of the extension in order that each of the arms angles forward from the rear wall and toward the rear edge.

8. The grid plate as recited in claim 4 wherein the rear edge has an extension on which both of the arms are attached in order that after each of the gripping means fully engages the associated one of the side walls, each of the arms angles forward from the rear wall and toward the rear edge.

9. The grid plate as recited in claim 4 wherein the first edge is generally straight and has an end portion which angles toward the end; wherein the second edge is generally straight and has an end portion which angles toward the end; and wherein the gripping means is a point at the end formed by the end portions which angle toward the end.

10. The grid plate as recited in claim 9 wherein the first edge of each of the arms has an intermediate portion adjacent the end portion and opposite from the point at the end; wherein the arms flex forwardly toward the rear edge of said conductive plate after the intermediate portion of the first edge of each of the arms engages the rear wall in order that the point at the end of each of the arms engages the associated one of the side walls.

11. The grid plate as recited in claim 1 wherein said conductive plate is a generally rectangular conductive-magnetic plate with a front arc edge which is opposite the rear edge; wherein each of the sides has a front end which terminates at about the front arc edge and a rear end which terminates at about the rear edge; and wherein each of the gripping means engages the associated one of the side walls between the rear end of said conductive-magnetic plate and the rear wall of said arc box.

12. An electrical switching device comprising:

separable contacts which interrupt current through said electrical switching device when opened, said separable contacts having a first conductor and a second conductor electrically connected thereto;

arc box means for housing said separable contacts therein, said arc box means having a rear wall and two side walls each of which has a plurality of parallel grooves; and a plurality of conductive plates each of which has two sides and a rear edge; each of the sides being slidable within one of the grooves of one of the side walls of said arc box means; the rear edge having two arms being rearwardly disposed therefrom, each of the arms having gripping means for gripping an associated one of the side walls, each of the gripping means being generally disengaged from the associated one of the side walls during insertion of the sides of one of said conductive plates into a pair of the grooves of said arc box means, each of the arms being engaged by the rear wall of said arc box means and flexing forwardly toward the rear edge of said one of said conductive plates in order that each of the gripping means engages the associated one of the side walls and retains said one of said conductive plates within the pair of the grooves of said arc box means, a portion of each of said conductive plates being disposed between the first conductor and the second conductor in order to strike an arc therebetween when said separable contacts are opened.

13. The electrical switching device as recited in claim 12 wherein each of said conductive plates is planar and has a front arc edge which is coplanar with the front arc edge of each other of said conductive plates; and wherein the arc between the first conductor and the second conductor is generally struck between the front arc edges of each of said conductive plates.

14. The electrical switching device as recited in claim 13 wherein each of said conductive plates is generally rectangular with the front arc edge being opposite the rear edge; wherein each of the sides has a front end which terminates at the front arc edge and a rear end which terminates at the rear edge; wherein each of the gripping means grips a portion of the associated one of the side walls; and wherein each of the gripping means engages the associated one of the side walls between the rear end of said conductive plates and the rear wall of said arc box means in order that the arc which is generally struck between the front arc edges of each of said conductive plates is separated from the portions of the side walls which are gripped by the gripping means.

15. The electrical switching device as recited in claim 12 wherein the rear edge of said conductive plates has a center; and wherein each of the arms is rearwardly disposed from about the center of the rear edge.

16. The electrical switching device as recited in claim 15 wherein each of the arms is angularly disposed with respect to the rear edge during insertion of the sides of one of said conductive plates into a pair of grooves of said arc box means; and wherein each of the arms is generally parallel with respect to the rear edge after each of the gripping means engages the associated one of the side walls.

17. The electrical switching device as recited in claim 12 wherein each of the arms has a first edge which faces the rear wall, a second edge which faces the rear edge, and an end which faces the associated one of the side walls after each of the gripping means engages the associated one of the side walls; and wherein the second edge has a tab which extends generally transversely therefrom toward the rear edge and which engages the rear edge when each of the gripping means fully engages the associated one of the side walls in order that each of the arms remains generally parallel with respect to the rear edge.

18. The electrical switching device as recited in claim 12 wherein each of the arms has a first edge which faces the rear wall, a second edge which faces the rear edge, and an end which faces the associated one of the side walls after each of the gripping means engages the associated one of the side walls; wherein the first edge is generally straight and has an end portion which angles toward the end; wherein the second edge is generally straight and has an end portion which angles toward the end; and wherein the gripping means is a point at the end formed by the end portions which angle toward the end.

19. The electrical switching device as recited in claim 18 wherein the first edge of each of the arms has an intermediate portion adjacent the end portion and opposite from the point at the end; wherein the arms flex forwardly toward the rear edge of said conductive plate after the intermediate portion of the first edge of each of the arms engages the rear wall in order that the point at the end of each of the arms engages the associated one of the side walls.

20. The electrical switching device as recited in claim 12 wherein each of the arms has a first edge which faces the rear wall, a second edge which faces the rear edge, and an end which faces the associated one of the side walls after each of the gripping means engages the associated one of the side walls; and wherein the rear edge has an extension on which both of the arms are attached in order that after each of the gripping means fully engages the associated one of the side walls, each of the arms angles forward from the rear wall and toward the rear edge.

* * * * *